United States Patent [19]

Savanick et al.

[11] Patent Number: 4,663,893

[45] Date of Patent: May 12, 1987

[54] END DEFLECTOR FOR ABRASIVE WATER JET SLOT CUTTER

[75] Inventors: George A. Savanick, Apple Valley; Walter G. Krawza, Lakeville; Steven W. Connors, Minneapolis, all of Minn.

[73] Assignee: The United States of America as represented by the Secretary of the Interior, Washington, D.C.

[21] Appl. No.: 809,651

[22] Filed: Dec. 16, 1985

[51] Int. Cl.[4] ..... B24C 5/04

[52] U.S. Cl. ..... 51/439; 51/427; 239/522

[58] Field of Search ..... 51/439, 411, 427, 319–321, 51/410; 299/17; 239/518, 521, 522

[56] References Cited

U.S. PATENT DOCUMENTS

| | | | |
|---|---|---|---|
| 2,439,032 | 4/1948 | Almen | 51/439 |
| 2,897,692 | 8/1959 | Beekner et al. | 51/439 |
| 3,994,097 | 11/1976 | Lamb | 51/439 |
| 4,218,855 | 8/1980 | Wemmer | 51/439 |
| 4,369,607 | 1/1983 | Bruggeman et al. | 51/439 |

FOREIGN PATENT DOCUMENTS

| | | | |
|---|---|---|---|
| 0810812 | 3/1959 | United Kingdom | 51/411 |
| 0730558 | 4/1980 | U.S.S.R. | 51/439 |

*Primary Examiner*—Frederick R. Schmidt
*Assistant Examiner*—Robert A. Rose
*Attorney, Agent, or Firm*—Thomas Zack; E. Philip Koltos

[57] ABSTRACT

An end deflector for an abrasive water jet slot cutter is provided. The end deflector includes two wear resistant plates which direct portions of the water jet upwardly and downwardly. Preferably, the abrasive water jet slot cutter includes a source of high pressure water and a high pressure water outlet from which a stream of water is expelled. A venturi device is provided adjacent the water outlet for creating a vacuum. A feed device feeds an abrasive particular material to the venturi device so that the abrasive material is entrained in the stream of water. Thereafter, the stream of water is collimated in a tube which produces a cylindrical water jet which is then deflected before it impinges on the rock to mine the rock. The abrasive material is preferably sand and the tube including the deflector is easily replaceable.

11 Claims, 3 Drawing Figures

END DEFLECTOR FOR ABRASIVE WATER JET SLOT CUTTER

FIELD OF THE INVENTION

The present invention relates generally to the cutting of hard rock in quarries and underground mines, and in particular to a jet deflector for an abrasive water jet slot cutter which deflector causes a wide slot to be cut in hard rock in quarries and undergound mines.

BACKGROUND OF THE INVENTION

Many underground metal mines remove large volumes of waste rock along with the metal values during the mining cycle. This occurs because these ore bodies occur in the form of thin beds or veins, the thickness of which is much smaller than the smallest practical size for entry headings necessary for mining operations. The resulting dilution of the ore values is very undesirable because it increases costs for handling and milling of the ores.

The underground metal mining industry has long sought an effective means of selectively mining or separating the ore values from waste during the mining cycle. Many attempts have been made to achieve this capability using various types of mechanical cutters and picks. These approaches have met with little success because of difficulties in gaining access to the vein beyond a short distance from the face in hard rock.

In order to cut hard rock in quarries and underground mines to mine veins, various mechanical devices have been used which use bits. However, these devices show severe wear when used in hard rock. Abrasive water jet designs have also been proposed for use in hard rock. However, such devices have been unable to make deep cuts because of significant energy losses and dispersion as the abrasive slurry moves away from the high pressure water nozzle. In addition, normal kerf cutters and high pressure water jet drills require excessively high pressure (50,000 psi) for cutting hard rock. Because of these high pressures, these devices tend to be unreliable. Usually, the most unreliable part is the swivel because the seals fail so readily under the pressures and rotation rates.

One prior art mining cutter using water jet pressure is disclosed in U.S. Pat. No. 4,280,735 (Lobbe). In this patent, a tool for a mineral winning machine is disclosed having a flat plate-like body with a bore containing a nozzle insert and a hard metal cutting region or blade. High pressure water is conveyed through the bore and nozzle insert to discharge as a jet which is directed to impinge against the mineral or coal face.

Another prior art water jet mining device is disclosed in U.S. Pat. No. 4,265,487 (Barker). According to the disclosure of this patent, a machine is provided in which a plurality of nozzle modules are mounted. Each nozzle module contains a high pressure water jet nozzle disposed to oscillate in a particular plane. The nozzle modules are oriented to cut in vertical and horizontal planes on the leading edge of the machine and the coal so cut is cleaved off by a wedge-shaped body.

Still another hydraulic cutting tool is disclosed in U.S. Pat. No. 4,240,664 (Mahyera et al). The device disclosed in this patent is designed for cutting kerfs in rocks and other hard formations by provision of divergent hydraulic jets in a cutter implement. The cutter implement cuts clearance for passage of the implement into the kerf being cut. The cutting implement includes a generally elongate nozzle housing with longitudinally spaced apart and transversely directed jet nozzles therein.

Disclosed in U.S. Pat. No. 4,119,160 (Summers et al) is an apparatus for water jet drilling of rocks including a nozzle. This nozzle is rotated and includes two outlets. One outlet is directed in a direction of movement of the nozzle while the other outlet is directed in an angle to this direction. In this manner, a cylindrical bore is drilled in the rock. A variety of other outlet designs is also disclosed in U.S. Pat. No. 3,796,371 (Taylor et al).

Disclosed in U.S. patent application Ser. No. 699,513 (now abandoned) is an abrasive water jet slot cutter including an elongate tube from which the water jet exits. Although this water jet slot cutter has proven especially effective, the collimated abrasive water jet cuts too narrow a kerf to permit the collimating tube to follow into the cut. Thus, in order to advance the kerf to the depths required in many mining applications, two parallel kerfs have to be cut and the intervening rock rib removed. Mechanically, this created the requisite clearance so that the collimator could be advanced in the kerf and to continue the cutting deeper into the rock. However, this was a continuous, two-step process which was unduly time consuming.

SUMMARY OF THE INVENTION

In accordance with the present invention, a deflector for deflecting a cylindrical jet of abrasive fluid is provided. The abrasive jet of fluid is used to cut into hard rocks and exits from an elongate tube having an outlet. The deflector includes a first and second wear resistant plate and a means for mounting these plates on the outlet of the tube. These plates are mounted such that a portion of the jet is deflected in a first forward direction and another portion of the jet is deflected in a forward direction opposite to the first mentioned direction. Preferably, one plate is mounted on one side of the outlet and the other plate is mounted on the other side of the outlet. In addition, the plates are preferably separated from one another so that still another portion of the jet passes between the plate undeflected.

Also in accordance with the present invention, an abrasive water jet slot cutter having a deflector such as described above is provided. The water jet slot cutter includes a source of high pressure and a high pressure water outlet adjacent to the source of high pressure from which a stream of water is expelled. A venturi means is also provided adjacent the water outlet for creating a vacuum. A feed means feeds an abrasive particular material into the venturi means whereby the abrasive material is entrained in the stream of water. A collimating means is then used for collimating the abrasive entrained stream of water into a cylindrical water jet which impinges on hard rock to mine hard rock.

In the preferred embodiment of the present invention, the collimating means is an elongate tube. In addition, the pressure of the source of high pressure water is about 10,000 psi and the abrasive material sand. Preferably, the sand is fed at an acute angle to the stream of water and the high pressure outlet and the tube are coaxial.

In the preferred embodiment, the elongate tube is held in the device by a tube holding means by which the tube can be easily released from the device in order to substitute a new tube and deflector. Thus, any abrasive wearing of the tube and deflector is easily compensated for by replacement of a new tube as necessary.

It is an advantage of the present invention that selective mining in underground mines is accomplished where the ore values are contained in only a portion of the mining face. With the present invention, the ore is selectively extracted so that beneficiating of the barren rock is avoided.

It is also an advantage of the present invention that harder rocks can be cut.

It is a further advantage of the present invention that frictional wear between the tool and the rocks does not occur.

Still another advantage of the present invention is that the collimating abrasive water jet can cut to distances over 6 feet from the end of the water jet tube without significant loss of power. Therefore, deep slots can be cut into previous kerfs.

In addition, as the deflector provides for a cut into the rock of sufficient size to receive the tube, the length of the tube can also be inserted into the kerf for even deeper cuts. This wide cut is made on a single pass so that the deep kerfs are made by an uninterrupted sequence of small advances into the rock using a translatory motion.

Yet another advantage of the present invention is the abrasive wear caused by the abrasive slurry is limited to an inexpensive, easily changed, throwaway collimating tube or pipe. No precisely manufacture constricting nozzles are required for the abrasive slurry.

Other features and advantages of the present invention are stated in or apparent from a detailed description of a presently preferred embodiment of the invention found hereinbelow.

DETAILED DESCRIPTION OF THE PREFERRED EMBODIMENT

Figure 1:
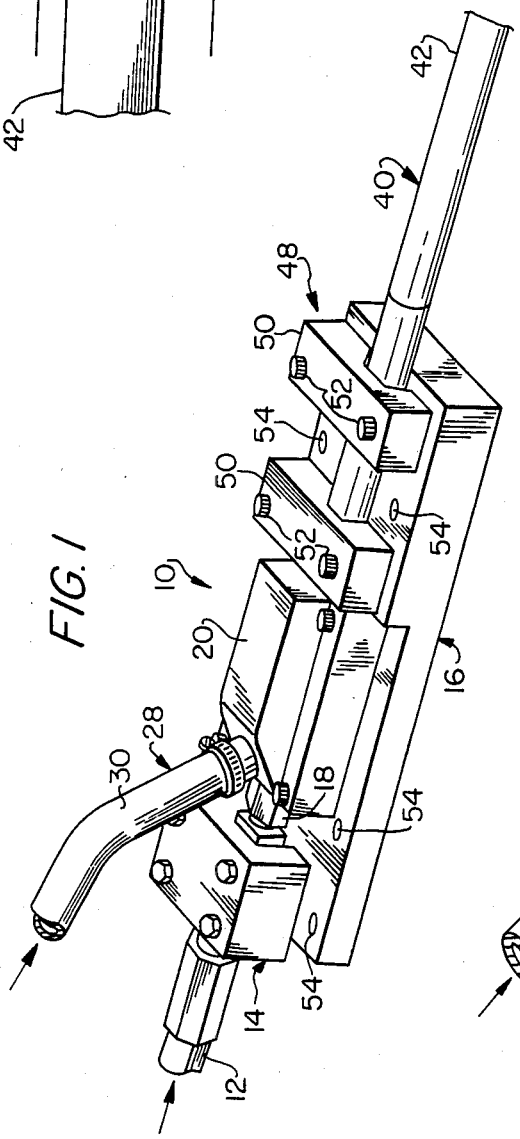
FIG. 1 is a side perspective view of the abrasive water jet slot cutter of the present invention.

With reference now to the drawing in which like numerals represents like elements in the views, an abrasive water jet slot cutter 10 is depicted in FIG. 1. Slot cutter 10 includes a source 12 of high pressure water. With the present invention, the source 12 of high pressure water is approximately 10,000 psi. Source 12 of high pressure water is connected via a coupling member 14, which is attached to a flat base 16, to a restrictor 18.

Figure 2:
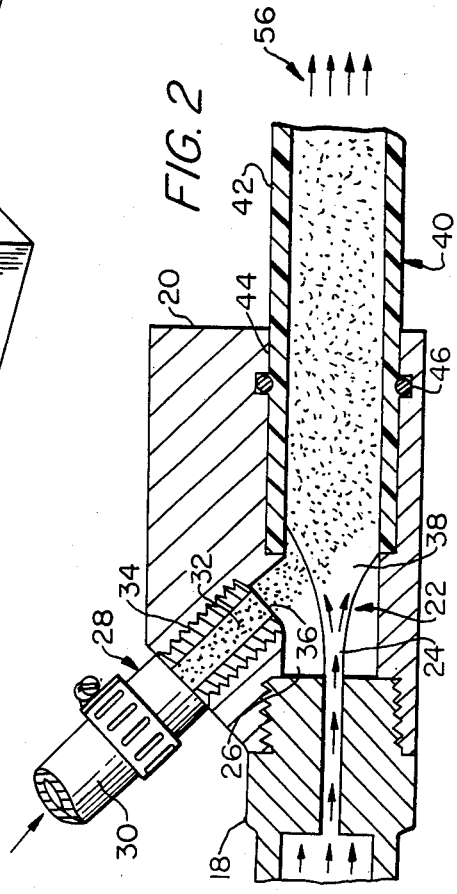
FIG. 2 is a side cross-sectional view of a portion of the slot cutter depicted in FIG. 1.

As shown in more detail in FIG. 2, restrictor 18 is threadably received in a housing 20 which is attached to flat base 16. Housing 20 includes a venturi means 22 including an outwardly opening outlet 24 in restrictor 18 and a cavity 26. Also connected to venturi means 22 is a feed means 28. Feed means 28 includes a source 20 of abrasive particle 32. Preferably, abrasive particles 32 are dry sand or a water-sand slurry. As shown, source 30 is connected to a threaded connector 34 which includes an outlet 36 in housing 20. Preferably, water connector 34 is disposed at an acute angle to a stream 38 of water exiting outlet 24 of restrictor 18 as shown in FIG. 2.

Due to the vacuum created by venturi means 22, stream 38 of water entrains abrasive particles 32 therein. Thereafter, stream 38 of water together with abrasive particles 32 are received in a collimating means 40. Collimating means 40 includes an elongate tube 42 as shown. Tube 42 is received in housing 20 in a complimentary sized hole 44. Disposed in hole 44 is an o-ring 46 which seals the outer periphery of tube 42 and hole 44.

In order to hold tube 42 in hole 44, a holding means 48 is provided. Holding means 48 includes two blocks 50 which are used to clamp tube 42 to flat base 16 by means of bolt 52. By use of holding means 48, tube 42 is easily replaced by loosening bolt 52 and withdrawing tube 42 from between blocks 50 and flat base 16. A new tube 42 is then easily inserted in place of old tube 42 and bolts 52 tightened.

Figure 3:
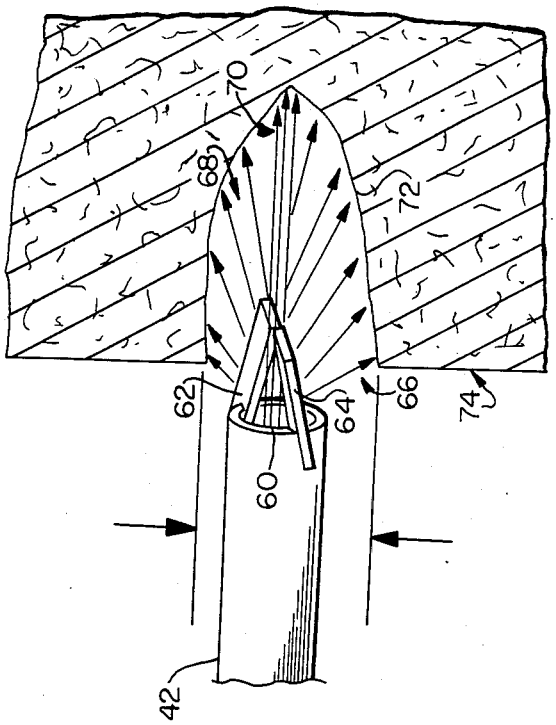
FIG. 3 is a side perspective view of the end deflector of the present invention.

As shown in greater detail in FIG. 3, tube 42 includes an outlet 60 from which the water jet 56 exits. Where tube 42 is moved laterally, a first wear resistant plate 62 and a second wear resistant plate 64 are located on opposite lateral sides of outlet 60. Conveniently, plate 62 and 64 are attached to tube 42 by welding.

As shown, plate 62 is angled downwardly so that a portion 66 of water jet 56 is deflected downwardly upon exiting outlet 60. Similarly, plate 64 is angled upwardly so that portion 68 of water jet 56 is deflected upwardly. It should also be noted that plate 62 and 64 are separated laterally from one another so that a portion 70 of water jet 56 is underflected and continues straight ahead of tube 42.

In operation, slot cutter 10 functions in the following manner. Initially, it should be appreciated that flat base 16 of slot cutter 10 is preferably attached (as by suitable bolts through attaching holes 54) onto a suitable carrier such as the articulated arm of a drill carrier. Such a drill carrier is remotely operated so that the operator is kept out of the back wash of slot cutter 10.

Upon actuation of slot cutter 10 by raising source 12 of water to the operating pressure, source 12 supplies water to restrictor 18 and creates stream 38 in cavity 26 of venturi means 22. Stream 38 creates a vacuum in cavity 26 and thereby draws abrasive particles 32 from source 30 into stream 38. Thereafter, stream 38 containing abrasive particles 32 is received in collimating means 40 including tube 42. Tube 42 collimates stream 38 so that a high pressure abrasive fluid is conducted in tube 42 as a cylindrical water jet 56. Finally, at outlet 60, plates 62 and 64 cause water jet 56 to be split into a lower portion 66, an upper portion 68, and a straight ahead portion 70. By a continuous side to side motion of tube 42, a deep kerf 72 is cut into rock 74 as shown. It should be appreciated that the height of the cut made in rock 74 (indicated by the opposed arrows) is large enough to permit the length of tube 42 extending beyond flat base 16 to be extended into the cut rock and thereby produce very deep kerfs in the hard rock.

It should also be appreciated that slot cutter 10 of the present invention separates the ore values using water jet 56 to cut deep slots along the ore waste contact zone. This enables the ore to be selectively removed either by blasting or through the action of a wedge.

It should further be appreciated that the use of slot cutter 10 with a source 12 of high pressure water of approximately 10,000 psi enables slot cutter 10 to make use of reliable pumps, hoses, and fittings which are available at a reasonable price.

It should still further be appreciated that the coaxial alignment of restrictor 18 and tube 42 provides slot cutter 10 with an essentially linear flow of high pressure water therethrough. Therefore, no swivel is necessary which is apt to fail under the high pressures needed for operation of the present invention. In addition, slot cutter 10 produces a single water jet which is easily translated and which does not interfere with its own operation.

Although the present invention has been described with respect to an exemplary embodiment thereof, it will be understood by those of ordinary skill in the art that variations and modifications can be effected within the scope and spirit of the invention.

We claim:

1. A deflector for deflecting a cylindrical jet of abrasive fluid which jet is used to cut into hard rock, the deflector comprising:

an elongate collimating tube which conducts the jet to the rock to be cut, said tube having a central axis and an outlet from which the jet issues;

a first and a second wear resistant plate each plate having a planar deflecting surface which is inclined toward a plane containing the central axis, the plates being angles towards the central axis plane in a downstream direction, and approaching said central axis plane from opposite sides thereof; and a means for mounting said plates on and at the outlet of said tube such that a portion of the jet is a deflectible cutting in a down stream and slight sidewards direction and another portion of the jet is deflected for cutting in a downstream and slight sidewards direction which last-mentioned sidewards direction to form jet portions which diverge from opposite sides of said central axis plane is opposite to the first-mentioned sidewards direction.

2. A deflector as claimed in claim 1 wherein said mounting means mounts said plates such that said first plate is on one side of said outlet and said second plate is on the other side of said outlet.

3. A deflector as claimed in claim 2 wherein said mounting means mounts said plates such that said plates are separated from one another and still another portion of the jet passes between said plates undeflected.

4. A deflector as claimed in claim 3 wherein said mounting means is a weld betwen said tube and said plates.

5. An abrasive water jet slot cutter comprising:

a jet means for producing a cylindrical water jet containing entrained abrasive material; said means including an elongate collimating tube which conducts the jet to a material to be cut, said tube having a central axis and an outlet from which the jet issues;

a first and a second wear resistant plate each plate having a planar deflecting surface which is inclined toward a plane containing the central axis, the plates being angled toward the central axis plane in a downstream direction and approaching said central axis plane from opposite sides thereof; and a means for mounting said plates on and at said outlet of said tube, said first plate being mounted on one side of said outlet such that a portion of the jet on that side is deflected for cutting by said first plate in a downstream and slight sidewards direction, and said second plate being mounted on an opposite side of said outlet such that another portion of the jet is deflected for cutting in a downstream forward and slight sidewards direction, which last-mentioned sidewards direction is opposite to the first-mentioned sidewards direction to form jet portions which diverge from opposite sides of said central axis plane.

6. An abrasive water jet cutter as claimed in claim 5 wherein said mounting means mounts said plates such that said plates are separated from one another and still another portion of the jet passes between said plates undeflected.

7. An abrasive water jet cutter as claimed in claim 6 wherein said jet means comprises:

a source of high pressure water;

a high pressure water outlet adjacent said source of high pressure water from which a stream of water is expelled;

a venturi means for creating a vacuum adjacent said water outlet; and a feed means for feeding an abrasive particulate material to said venturi means such that said abrasive material is entrained in said stream of water and fed into said tube.

8. An abrasive water jet cutter as claimed in claim 7 wherein the abrasive material is sand.

9. An abrasive water jet cutter as claimed in claim 7 wherein said feed means feeds the abrasive material at an acute angle to the stream of water.

10. An abrasive water jet cutter as claimed in claim 7 and further including a tube holding means for releasably holding said tube in position such that said tube and said plates mounted thereto are easily replaceable.

11. An abrasive water jet cutter as claimed in claim 7 wherein said high pressure water outlet and said tube are coaxial.

* * * * *